US009989918B2

(12) United States Patent
Fujii

(10) Patent No.: US 9,989,918 B2
(45) Date of Patent: Jun. 5, 2018

(54) IMAGE FORMING APPARATUS HAVING DEFINED ARRANGEMENT OF HEAT DISCHARGE DUCT

(71) Applicant: CANON KABUSHIKI KAISHA, Tokyo (JP)

(72) Inventor: Masahiko Fujii, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/234,194

(22) Filed: Aug. 11, 2016

(65) Prior Publication Data

US 2017/0060086 A1 Mar. 2, 2017

(30) Foreign Application Priority Data

Aug. 24, 2015 (JP) ..... 2015-164763

(51) Int. Cl.

| | |
|---|---|
| ***G03G 21/20*** | (2006.01) |
| ***G03G 15/20*** | (2006.01) |
| ***G03G 15/08*** | (2006.01) |
| ***G03G 21/16*** | (2006.01) |

(52) U.S. Cl.

CPC ..... *G03G 21/206* (2013.01); *G03G 15/0867* (2013.01); *G03G 15/2017* (2013.01); *G03G 21/1604* (2013.01); *G03G 21/1619* (2013.01)

(58) Field of Classification Search

CPC ..... G03G 21/206; G03G 15/0867; G03G 15/2017

USPC ..... 399/92

See application file for complete search history.

(56) References Cited

U.S. PATENT DOCUMENTS

2008/0240781 A1* 10/2008 Murano ..... G03G 21/1619 399/122

2014/0126925 A1* 5/2014 Ueno ..... G03G 21/206 399/92

FOREIGN PATENT DOCUMENTS

| | | | |
|---|---|---|---|
| JP | 2000-305439 | A | 11/2000 |
| JP | 2005-260593 | A | 9/2005 |
| JP | 2006-330565 | A | 12/2006 |
| JP | 2011-242635 | A | 12/2011 |
| JP | 2013-195810 | A | 9/2013 |

OTHER PUBLICATIONS

U.S. Appl. No. 15/234,185, filed Aug. 11, 2016, Masahiko Fujii.

* cited by examiner

*Primary Examiner* — Susan Lee

(74) *Attorney, Agent, or Firm* — Fitzpatrick, Cella, Harper & Scinto

(57) ABSTRACT

An image forming apparatus includes a duct discharging a heat in a vicinity of a heating unit to an outer side of the image forming apparatus, a stay, and a toner cartridge storing a toner being supplied to a developing unit. The stay is arranged to be positioned between the duct and the toner cartridge in the vertical direction.

23 Claims, 5 Drawing Sheets

IMAGE FORMING APPARATUS HAVING DEFINED ARRANGEMENT OF HEAT DISCHARGE DUCT

BACKGROUND OF THE INVENTION

Field of the Invention

The present invention relates to an image forming apparatus utilizing an electro-photographic technique, such as a printer, a copying machine, a facsimile machine or a multifunction machine.

Description of the Related Art

In an image forming apparatus where recording materials are discharged within a body of the image forming apparatus, a stay is provided below a sheet discharge unit, so as to allow an optional unit to be arranged in a vicinity of the sheet discharge unit or to provide reinforcement to take measures against a load applied to the sheet discharge unit. On the other hand, for example, Japanese Unexamined Patent Application Publication No. 2013-195810 discloses a configuration where a heat exhaust duct discharging heat from a fixing unit of the image forming apparatus is provided below the sheet discharge unit in a vertical direction of the image forming apparatus, and a toner cartridge supplying a developer to a developing unit is provided below the sheet discharge unit.

In such a configuration, when a heat exhaust duct is arranged below the stay and a toner cartridge is arranged below the heat exhaust duct in the vertical direction, the heat of the heat exhaust duct itself may have a direct influence on the toner cartridge. In contrast, if a stay is provided between the heat exhaust duct and the toner cartridge, the heat from the heat exhaust duct is conducted to the stay before being transmitted to the toner cartridge, so that heat can be diffused effectively.

SUMMARY OF THE INVENTION

The present invention provides an image forming apparatus capable of reducing the increase of temperature of the toner cartridge arranged below a duct that discharges heat, with a simple configuration. According to a first aspect of the present invention, the image forming apparatus includes an image forming unit configured to form a toner image on a recording material, the image forming unit comprising an image bearing member and a developing unit forming the toner image on the image bearing member, an image heating unit configured to heat the toner image formed on the recording material, a supporting unit, provided above the image forming unit in a vertical direction, configured to support the recording material discharged from the image forming apparatus, a duct, provided below the supporting unit in the vertical direction, configured to discharge a heat in a vicinity of the image heating unit to an outer side of the image forming apparatus, a frame body of the image forming apparatus which comprises a front side plate and a rear side plate, a stay which is supported on the front side plate and the rear side plate, and a toner cartridge which is capable of inserting to the image forming apparatus in a direction along the stay, and storing a toner being supplied to the developing unit. The stay is arranged to be positioned between the duct and the toner cartridge in the vertical direction.

According to a second aspect of the present invention, an image forming apparatus includes first and second image forming units respectively comprising an image bearing member and a developing unit forming a toner image on the image bearing member, and forming a toner image on a recording material, an image heating unit configured to heat the image formed on the recording material, a supporting unit, provided above the first and second image forming units in a vertical direction, configured to support the recording material discharged from the image forming apparatus, a duct, provided below the supporting unit in the vertical direction, configured to discharge heat in a vicinity of the image heating unit to an outer side of the image forming apparatus, a frame body of the image forming apparatus comprising a front side plate and a rear side plate, a stay supported on the front side plate and the rear side plate, a first toner cartridge which is capable of being inserted into the image forming apparatus in a direction along the stay, and storing toner being supplied to the developing unit of the first image forming unit, and a second toner cartridge capable of being inserted into the image forming apparatus in a direction along the stay, and storing toner being supplied to the developing unit of the second image forming unit. The stay is arranged to be positioned between the duct and the first toner cartridge in the vertical direction, and not positioned above the second toner cartridge.

Further features of the present invention will become apparent from the following description of exemplary embodiments with reference to the attached drawings.

DESCRIPTION OF THE EMBODIMENTS

Image Forming Apparatus

Figure 1:
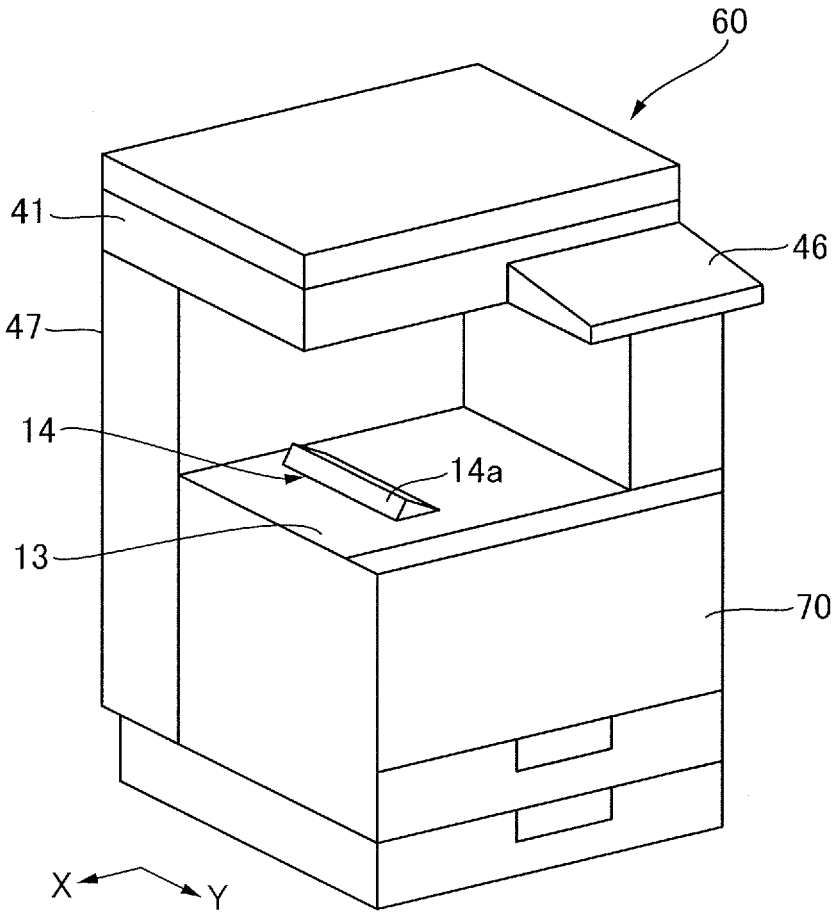
FIG. 1 is a perspective view of an exterior of an image forming apparatus according to a preferred embodiment.

Now, an image forming apparatus according to the present embodiment will be described with reference to FIGS. 1 through 5. FIG. 1 is a perspective view of an exterior of the image forming apparatus according to the present embodiment. An image forming apparatus 60 according to the present embodiment is a so-called in-body sheet ejection-type image forming apparatus. The image forming apparatus 60 has an image forming body, i.e., apparatus body, 70 forming an image on a recording material, i.e., a sheet, and an image reading unit 41 reading image information from a document. As illustrated, the image reading unit 41 is provided above the apparatus body 70. A sheet supporting unit 13 on which the recording material subjected to image forming in the apparatus body 70 is discharged and supported is formed between the apparatus body 70 and the image reading unit 41. A sheet discharge tray (not shown) is attached in a detachable manner to the sheet supporting unit 13. The sheet supporting unit 13 supports the recording material when external equipment (described later) is not attached. The apparatus body 70 includes an image forming portion capable of forming a toner image on a recording material, i.e., on a sheet, and a fixing unit 9 as an image heating portion heating the image formed on the recording material Further, the image forming apparatus 60 includes an operating unit 46 having a display unit, an input key and the like, and an electrical equipment unit 47 having a control unit controlling the whole apparatus, a power supply supplying power, and so on. The image forming apparatus also has an exhaust duct 14 as an exhaust passage discharging air within the apparatus body 70 to an exterior of the apparatus. The exhaust duct 14 is formed in a tubular shape using resin, and as described later (refer to FIG. 3 described later), the exhaust duct 14 is arranged to extend in an area between the sheet supporting unit 13 and toner bottles 605. The exhaust duct 14 has an exhaust port 14*a* arranged in a same direction as a direction of discharge of the recording material discharged from the apparatus body 70 (direction of arrow X in the drawing), and as illustrated, the exhaust port 14*a* is protruded outside the apparatus body 70 at the sheet supporting unit 13. That is, the air passing through the exhaust duct 14 is discharged toward the side having the sheet supporting unit 13, i.e., in the direction of arrow X of the drawing, instead of being discharged toward the front side of the apparatus, i.e., in the direction of arrow Y of the drawing. As described, the exhaust discharged from the exhaust duct 14 is prevented from blowing toward the user.

Figure 2:
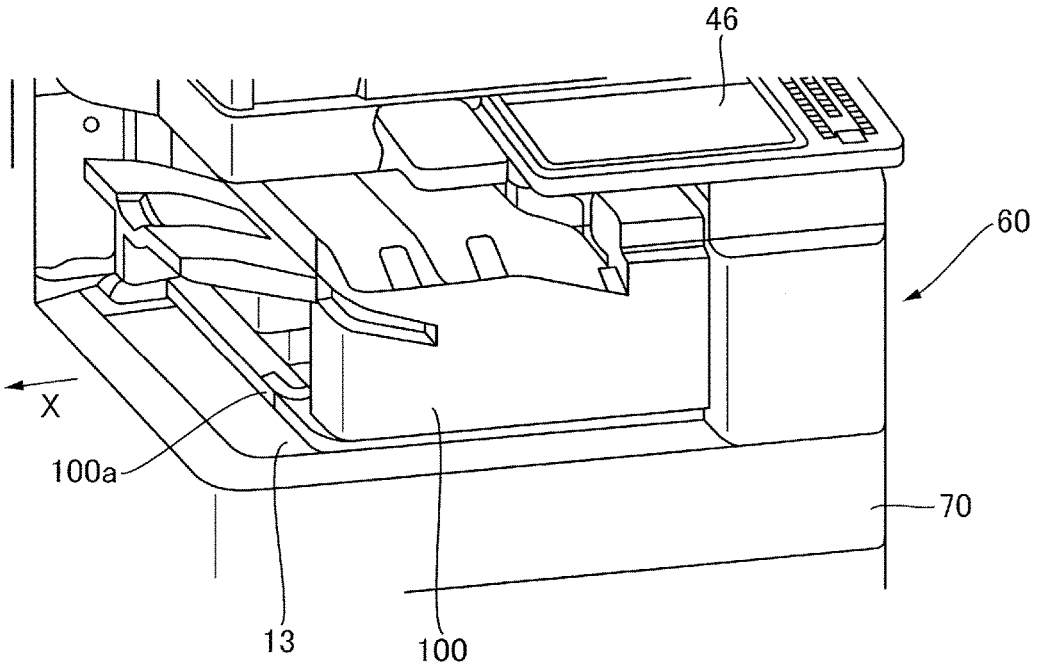
FIG. 2 is an enlarged view of a portion of the image forming apparatus of a case where a sheet processing apparatus is attached.

A sheet processing apparatus 100 as an external equipment can be mounted on the sheet supporting unit 13. FIG. 2 illustrates the image forming apparatus 60 with the sheet processing apparatus 100 mounted thereon. The sheet processing apparatus 100 is mounted on the sheet supporting unit 13 with the sheet discharge tray not mounted thereon. The sheet processing apparatus 100 is an apparatus performing a predetermined post processing to the received recording material, after receiving the recording material discharged from the apparatus body 70. The sheet processing apparatus 100 is capable of carrying out various types of post processing, such as a sorting and classifying process, a binding process, and a folding process, of the recording material. In the present image forming apparatus 60, a direction of removal of the sheet processing apparatus 100 is the same direction as a discharging direction of the recording material (direction of arrow X in the drawing). When mounting the sheet processing apparatus 100, the air passing through the exhaust duct 14 is discharged through a discharge port 100*a* of the sheet processing apparatus 100. The external equipment is not restricted to the sheet processing apparatus 100.

Figure 3:
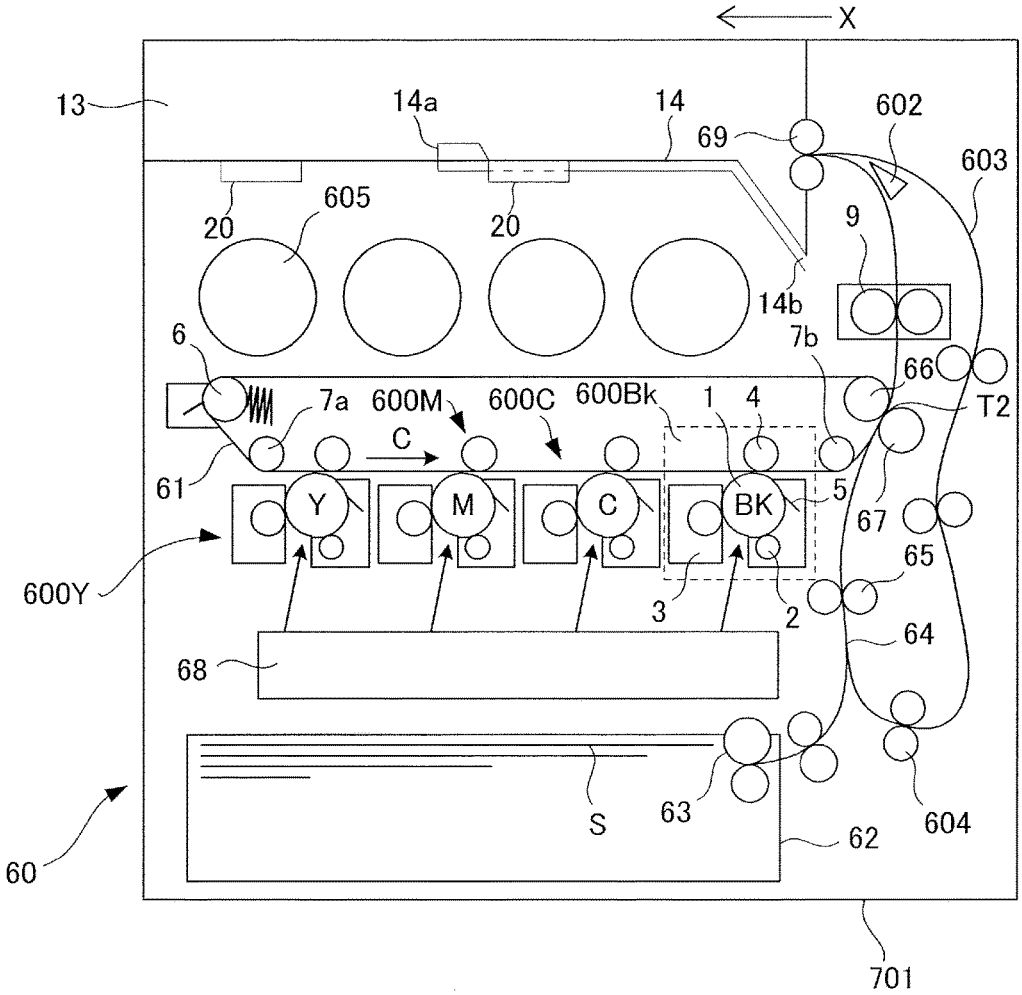
FIG. 3 is a cross-sectional view of a configuration of the image forming apparatus.

Image forming performed on the recording material in the image forming apparatus 60 is described with reference to FIG. 3. FIG. 3 is a cross-sectional view of a configuration of the image forming apparatus. The image forming apparatus 60 illustrated in FIG. 3 is a so-called tandem-type intermediate transfer apparatus, having image forming units 600Y through 600Bk of four colors, that are Y, M, C and Bk, arranged to face an intermediate transfer belt 61 within the apparatus body 70.

A conveyance process of a recording material of the image forming apparatus 60 will be described. The recording material S is stored in a state being supported within a recording material storage, i.e., cassette, 62, and the recording material is fed at a matched timing with the image forming timing via a sheet feed roller 63. For example, a friction separation method is adopted to feed sheets from a recording material storage, i.e., cassette, 62. The recording material S sent out by the sheet feed roller 63 is conveyed to a registration roller 65 arranged in a middle of a conveyance path 64. After skew feed correction and timing correction of the recording material S have been performed in the registration roller 65, the recording material S is transmitted to a secondary transfer portion T2. The secondary transfer portion T2 is a transfer nip portion formed of a secondary transfer inner roller 66 and a secondary transfer outer roller 67 opposed to one another, and a toner image is attracted on the recording material S by providing a predetermined pressurizing force and a static load bias to the transfer nip portion.

An image forming process of a toner image having been transmitted to the secondary transfer portion T2 at a similar timing as the conveyance process of the recording material S to the secondary transfer portion T2 described above will be described. At first, image forming units 600Y through 600Bk will be described, but the configuration of image forming units of the respective colors are basically the same, except for the toner colors, so that in the following description, the image forming unit 600Bk of a black (Bk) color toner will be described as a representative example.

The image forming unit 600Bk is mainly composed of a photosensitive drum 1, i.e., image bearing member, mainly bearing a toner image, a charging apparatus 2, a developing apparatus 3, a primary transfer apparatus 4, a photosensitive drum cleaner 5, and so on. A surface of the photosensitive drum 1 driven to rotate has a surface charged evenly in advance by the charging apparatus 2, and thereafter, an electrostatic latent image is formed by an exposing unit driven by signals and the like of an image information read by the above-described image reading unit 41. Next, the electrostatic latent image formed on the photosensitive drum 1 is visualized through toner development by the developing apparatus 3. That is, a toner image is formed on the image bearing member by the developing apparatus 3, i.e., developing unit. Thereafter, a predetermined pressurizing force and static load bias is applied by the primary transfer apparatus 4 arranged facing the image forming unit 600Bk with an intermediate transfer belt 61 intervened, and the toner image formed on the photosensitive drum 1 is primarily transferred to the intermediate transfer belt 61. Transfer residual toner remaining slightly on the photosensitive drum 1 is removed by the photosensitive drum cleaner 5, and the apparatus can be prepared again for the next image forming process.

The above-described image forming unit adopting a configuration of FIG. 3 will have four sets of image forming units, i.e., yellow (Y), magenta (M), cyan (C) and black (Bk). However, the number of colors is not restricted to four, and the order in which the colors are arranged is not restricted to the illustrated example. The toners used in the developing apparatus 3 are provided from toner bottles 605Y through 605Bk of respective colors attached in a detachable manner to the image forming apparatus 60. The toner bottles 605Y through 605Bk are arranged in a row in the horizontal direction at an upper area of corresponding image forming units 600Y through 600Bk, and function as toner supplying apparatuses. The toner bottles 605Y through 605Bk, i.e., toner storing containers, are respectively formed in a long tubular shape, and arranged in parallel and in a detachable manner to the apparatus body 70. The direction in which the toner bottles 605Y through 605Bk are detached from the apparatus body 70 is a direction intersecting a direction in which the above-mentioned sheet processing apparatus 100 is detached, that is, the direction of arrow X in FIG. 3, i.e., from the depth side toward the front side of the drawing. As described, the toner bottles 605Y through 605Bk are stored within the apparatus body 70 so that the longitudinal direction of the toner bottles intersects with the discharging direction of the recording material S. The sheet supporting unit 13 is disposed above the toner bottles 605Y through 605Bk. In other words, the sheet supporting unit 13 is arranged on the upper portion of the image forming units 600Y through 600Bk and the toner bottles 605Y through 605Bk in the vertical direction, and designed to support recording materials discharged from the image forming apparatus.

The intermediate transfer belt 61 will now be explained. The intermediate transfer belt 61 is an endless belt stretched by a tension roller 6, the secondary transfer inner roller 66, and stretch rollers 7*a* and 7*b*, and driven to rotate toward an arrow C direction in the drawing. The secondary transfer inner roller 66 also functions as a drive roller driving the intermediate transfer belt 61. The image forming processes of respective colors subjected to parallel processing in the respective image forming units 600Y through 600Bk of yellow, magenta, cyan and black are performed at such timings so that a toner image is sequentially respectively superposed on a toner image of an upstream color having been primarily transferred to the intermediate transfer belt 61. As a result, a full-color toner image is finally formed on the intermediate transfer belt 61 and conveyed to the secondary transfer portion T2.

According to the conveyance process and the image forming process described above, the timings of the recording material S and the full-color toner image are matched at the secondary transfer portion T2, where secondary transfer is performed. Thereafter, the recording material S is conveyed to the fixing unit 9, and the toner image formed on the recording material S, i.e., sheet, is heated, melted and fixed onto the recording material S. The recording material S having an image fixed thereto in the above-described manner is selected to be either discharged onto the sheet supporting unit 13 or subjected to duplex image forming, by a forward rotation of a sheet discharge roller 69.

When duplex image forming is required, the recording material S is conveyed by the forward rotation of the sheet discharge roller 69 until a trailing edge of the recording material S passes a switching member 602, and thereafter, the sheet discharge roller 69 is rotated in a reverse rotation to switch the leading and trailing edges, and the recording material S is conveyed to a duplex conveyance path 603. Thereafter, the recording material S is sent via a re-feeding roller 604 at a matched timing with the recording material of a subsequent job conveyed by the sheet feed roller 63. The conveyance and the image forming process on the rear surface of the sheet is similar to the above-described example, so that the descriptions thereof are omitted.

Exhaust Duct

The exhaust duct 14 is provided to discharge the heat generated at the fixing unit 9 and the like during image formation and resides in an area between the secondary transfer outer roller 67 and the fixing unit 9. That is, the exhaust duct 14 is a duct arranged above the toner bottles 605Y through 605Bk and below a sheet supporting unit, i.e., supporting unit, 13 in the vertical direction, and discharges the heat residing in the vicinity of a fixing unit, i.e., image heating unit, 9 to the outer side of the image forming apparatus. Therefore, as illustrated in FIG. 3, the exhaust duct 14 has an inlet port 14*b* arranged in the vicinity of the fixing unit 9, which is a main heat source within the apparatus body 70. On the other hand, as already described, the exhaust duct 14 is arranged so that the exhaust port 14*a* protrudes outside the apparatus body 70, i.e., outside the apparatus body, at the sheet supporting unit 13, and so that the exhaust port 14*a* does not face the front side of the apparatus. The reason for such arrangement is that if the exhaust is discharged to the front side of the apparatus, the air containing heat may be discharged toward the user operating the operating unit 46 (refer to FIG. 1), which may feel unpleasant to the user. Further, an electrical equipment unit 47 (refer to FIG. 1) is arranged on the whole surface on the rear side of the apparatus, so that there is not enough space to extend the exhaust duct 14 to the rear side of the apparatus. Further, there is not enough space to extend the exhaust duct 14 to the side surface on which the conveyance path of the recording material S, such as the conveyance path 64 and the duplex conveyance path 603, is arranged, and the exhaust duct 14 cannot be easily arranged. Therefore, the exhaust duct 14 is extended between the sheet supporting unit 13 and the toner bottles 605Y through 605Bk, intersecting one or a plurality of toner bottles from the fixing unit 9 side to the side having the sheet supporting unit 1, and arranged in a direction intersecting the longitudinal direction of the toner bottles 605Y through 605Bk.

As described earlier, in the image forming apparatus 60, the sheet processing apparatus 100 can be arranged, instead of the sheet discharge tray, in the sheet supporting unit 13. However, compared to the sheet discharge tray, the sheet processing apparatus 100 has a heavier weight. A top panel is arranged between the sheet supporting unit 13 and the toner bottles 605Y through 605Bk, but the top panel is thin and does not have enough stiffness to support a heavy load such as the sheet processing apparatus 100. Therefore, a reinforcing sheet metal 20 is provided between the sheet supporting unit 13 and the toner bottles 605Y through 605Bk to support the sheet processing apparatus 100. The reinforcing sheet metal 20 will be described with reference to FIGS. 4 and 5.

Reinforcing Sheet Metal

Figure 4:
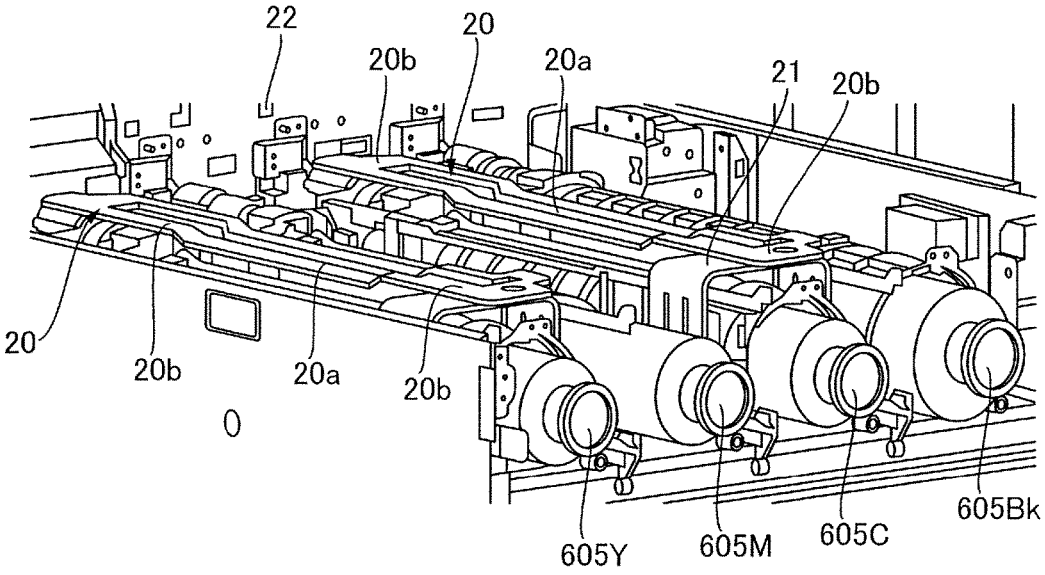
FIG. 4 is an explanatory perspective view of a reinforcing sheet metal.

As illustrated in FIG. 4, among the toner bottles 605Y through 605Bk arranged in the named order of black, cyan, magenta and yellow, from the side close to the fixing unit 9, a pair of reinforcing sheet metals 20, i.e., supporting members, is arranged to cover an upper portion of the toner bottle 605C of cyan toner and the toner bottle 605Y of yellow toner. The respective sheet metals are arranged to extend in the longitudinal direction of the toner bottle 605Y/605C, i.e., the direction of insertion of the toner bottle, and connected to a front side sheet metal 21, i.e., a front side plate, and a rear side sheet metal 22, i.e., a rear side plate, at the front and rear areas of the apparatus body 70. That is, in the present embodiment, support portions 20*b* are arranged above the toner bottle 605C, i.e., first toner cartridge, and the toner bottle 605Y, but the support portions 20*b* are not arranged above the toner bottle 605Bk, i.e., second toner cartridge, and the toner bottle 605M. The toner bottle 605C is at a positional relationship closer to the exhaust port 14*a* of the exhaust duct 14 than the toner bottle 605Bk. The above-described reinforcing sheet metals 20 forming a pair basically have the same configurations, so that the reinforcing sheet metal 20 disposed above the toner bottle 605C will be described hereafter as an example, and the configuration of the reinforcing sheet metal 20 disposed above the toner bottle 605Y will not be described. The front side sheet metal 21 and the rear side sheet metal 22 constitute a part of a metallic frame 701 (refer to FIG. 3) of the apparatus body 70, but are not restricted thereto. The reinforcing sheet metal 20 can be connected to another area having a high thermal conductivity and a high stiffness.

The reinforcing sheet metal 20 functioning as a stay supported on the front side sheet metal 21 and the rear side sheet metal 22 is a metal member formed in a concaved shape using metal having a high thermal conductivity, such as stainless steel. The reinforcing sheet metal 20 has a concave portion 20*a*, i.e., first portion, and a support portion 20*b*, i.e., second portion. The concave portion 20*a* allows the exhaust duct 14 extending in the direction crossing the longitudinal direction of the reinforcing sheet metal 20, that is, longitudinal direction of the toner bottle 605Y, to be received therein. In other words, the concave portion 20*a* is arranged between at least a portion of the toner bottle 605Y and the exhaust duct 14. The support portion 20*b* supports the sheet processing apparatus 100 mounted on the sheet supporting unit 13. In the example of FIG. 4, the support portions 20*b* are arranged at both ends of the reinforcing sheet metal 20, and the reinforcing sheet metal 20 is connected via the support portions 20*b* to the front side sheet metal 21 and the rear side sheet metal 22.

Figure 5:
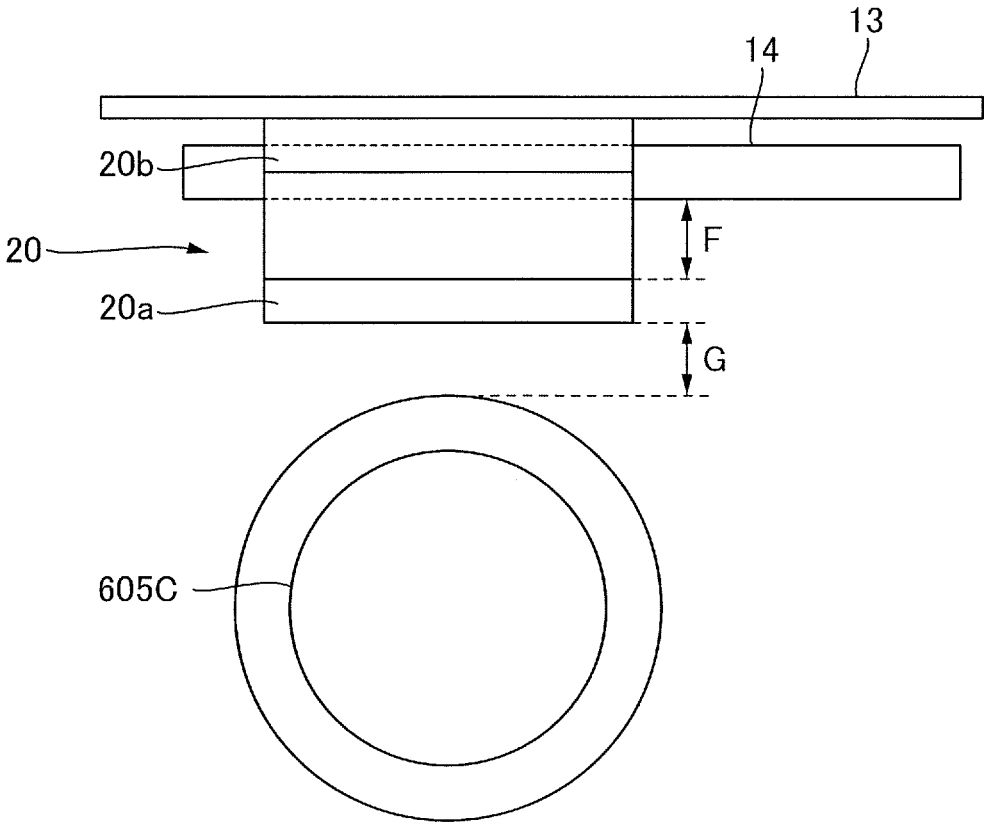
FIG. 5 is a frame format illustrating a positional relationship between an exhaust duct and a reinforcing sheet metal.

As illustrated in FIG. 5, regarding the reinforcing sheet metal 20, a depth of the concave portion 20*a* and a height of the support portion 20*b* are designed so that the support portion 20*b* is positioned higher in the vertical direction than an upper surface of the exhaust duct 14 received in the concave portion 20*a*. In other words, the support portion 20*b* protrudes closer to the sheet supporting unit than the exhaust duct 14, and supports the sheet processing apparatus 100 mounted on the sheet supporting unit 13. As described, the reinforcing sheet metal 20 is formed so that the upper surface of the exhaust duct 14 does not contact a lower surface of the sheet processing apparatus 100 supported on the support portion 20*b*.

Further, the reinforcing sheet metal 20 is arranged so that a gap, i.e., clearance, G is formed between the concave portion 20*a* and the toner bottle 605Y. The reinforcing sheet metal 20 is also arranged so that a gap, i.e., clearance, F is formed between the concave portion 20*a* and the exhaust duct 14. In other words, the reinforcing sheet metal 20 is arranged so that the concave portion 20*a* is not in contact with the toner bottles 605 and the exhaust duct 14. The depth of the concave portion 20*a* and the height of the support portion 20*b* are set so that the above-described relationship is realized.

As described, according to the image forming apparatus 60 of the present embodiment, the reinforcing sheet metal 20 connected to the apparatus body 70 is arranged between the exhaust duct 14 and the toner bottles 605Y through 605Bk. According to this configuration, even when the exhaust duct 14 is heated by the hot air passing through the exhaust duct 14, the heat from the exhaust duct 14 can be reflected or absorbed by the reinforcing sheet metal 20. Further, gaps are formed between the toner bottles 605Y through 605Bk and the reinforcing sheet metal 20, and between the exhaust duct 14 and the reinforcing sheet metal 20, so that air layers are formed in the gaps. The air layers have a high heat insulation property, and the effect of insulating heat from the toner bottles 605Y through 605Bk can easily be achieved. The reinforcing sheet metal 20 is connected to the apparatus body 70 via the front side sheet metal 21 and the rear side sheet metal 22, so that it becomes possible to conduct heat easily from the reinforcing sheet metal 20 to the apparatus body 70, i.e., connection destination, and release heat easily from the reinforcing sheet metal 20. A simple configuration as the one illustrated above can suppress the increase of temperature of toner bottles 605 by the influence of heat from the exhaust duct 14. If the increase of temperature of the toner bottles 605 can be suppressed, image forming can be performed successively for a long period of time without causing image defects.

The above-described embodiment has illustrated an image forming apparatus having a configuration where toner images of respective colors are primarily transferred from the photosensitive drums 1 of respective colors to the intermediate transfer belt 61, and then the combined multi-colored toner image is collectively secondarily transferred to the recording material S, but the present invention is not restricted to this example. For example, a direct transfer-type image forming apparatus can be adopted, where images are directly transferred from the photosensitive drums to the recording material. Further, a plurality of reinforcing sheet metals 20 can be provided to cover the upper portions of the respective toner bottles 605Y through 605Bk, or the sheet metal can be disposed integrally so that one reinforcing sheet metal covers the upper portion of a plurality of toner bottles. Further according to the present embodiment, the image forming units are configured to transfer the formed toner images via an intermediate transfer member to the recording material and form toner images on the recording material, but the intermediate transfer member can be eliminated, and toner images can be formed on the recording material by adopting a direct transfer method where the toner images are directly transferred onto the recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-164763, filed Aug. 24, 2015, which is hereby incorporated by reference herein in its entirety.

What is claimed is:

1. An image forming apparatus comprising:

an image forming unit configured to form a toner image on a recording material, the image forming unit comprising an image bearing member and a developing unit forming the toner image on the image bearing member;

an image heating unit configured to heat the toner image formed on the recording material;

a supporting unit, provided above the image forming unit in a vertical direction, configured to support the recording material discharged from the image forming apparatus;

a duct, provided below the supporting unit in the vertical direction, configured to discharge heat in a vicinity of the image heating unit to an outer side of the image forming apparatus;

a frame body of the image forming apparatus;

a toner cartridge which is provided below the duct in the vertical direction and capable of being inserted into the image forming apparatus in a direction from a front side of the image forming apparatus toward a rear side of the image forming apparatus, and storing toner to be supplied to the developing unit; and a stay respectively connected to a front side portion of the frame body and a rear side portion of the frame body, the toner cartridge and the duct being oppositely arranged with the stay interposed therebetween in the vertical direction.

2. The image forming apparatus according to claim 1, wherein a clearance is formed between the duct and the stay and a clearance is formed between the stay and the toner cartridge in the vertical direction.

3. The image forming apparatus according to claim 1, wherein the stay is a metal plate.

4. The image forming apparatus according to claim 1, wherein the toner cartridge is arranged above the image forming unit in the vertical direction.

5. The image forming apparatus according to claim 1, wherein the duct is configured to extend along a discharging direction in which the recording material is discharged from the image forming apparatus, and configured such that a discharging port of the duct is arranged downstream of the toner cartridge in the discharging direction.

6. An image forming apparatus comprising:

an image forming unit configured to form a toner image on a recording material, the image forming unit comprising an image bearing member and a developing unit forming the toner image on the image bearing member;

an image heating unit configured to heat the toner image formed on the recording material;

a supporting unit, provided above the image forming unit in a vertical direction, configured to support the recording material discharged from the image forming apparatus;

a duct, provided below the supporting unit in the vertical direction, configured to discharge heat in a vicinity of the image heating unit to an outer side of the image forming apparatus;

a frame body of the image forming apparatus which comprises a front side plate and a rear side plate;

a toner cartridge which is provided below the duct in the vertical direction and capable of being inserted into the image forming apparatus in a direction from the front side plate toward the rear side plate, and storing toner to be supplied to the developing unit; and a stay which is respectively connected to the front side plate and the rear side plate, the toner cartridge and the duct being oppositely arranged with the stay interposed therebetween in the vertical direction.

7. The image forming apparatus according to claim 6, wherein a clearance is formed between the duct and the stay and a clearance is formed between the stay and the toner cartridge in the vertical direction.

8. The image forming apparatus according to claim 6, wherein the stay is a metal plate.

9. The image forming apparatus according to claim 6, wherein the toner cartridge is arranged above the image forming unit in the vertical direction.

10. The image forming apparatus according to claim 1, wherein the duct is configured to extend along a discharging direction in which the recording material is discharged from the image forming apparatus, and configured such that a discharging port of the duct is arranged downstream of the toner cartridge in the discharging direction.

11. An image forming apparatus comprising:

first and second image forming units each comprising an image bearing member and a developing unit forming a toner image on the image bearing member, and configured to form the toner image on a recording material;

an image heating unit configured to heat the image formed on the recording material;

a supporting unit, provided above the first and second image forming units in a vertical direction, configured to support the recording material discharged from the image forming apparatus;

a duct, provided below the supporting unit in the vertical direction, configured to discharge heat in a vicinity of the image heating unit to an outer side of the image forming apparatus;

a frame body of the image forming apparatus comprising a front side plate and a rear side plate;

a first toner cartridge which is provided below the duct in the vertical direction, the first toner cartridge being configured to be inserted into the image forming apparatus in a direction directed from the front side plate toward the rear side plate, and configured to store toner to be supplied to the developing unit of the first image forming unit;

a second toner cartridge which is provided below the duct in the vertical direction and adjacent to the first toner cartridge, the second toner cartridge being configured to be inserted into the image forming apparatus in the direction directed from the front side plate toward the rear side plate, and configured to store toner to be supplied to the developing unit of the second image forming unit; and a stay respectively connected to the front side plate and the rear side plate, the first toner cartridge and the duct being oppositely arranged with the stay interposed therebetween in the vertical direction, the second toner cartridge and the duct being oppositely arranged without the stay interposed therebetween in the vertical direction.

12. The image forming apparatus according to claim 11, wherein a clearance is formed between the duct and the stay and a clearance is formed between the stay and the first toner cartridge in the vertical direction.

13. The image forming apparatus according to claim 11, wherein the stay is a metal plate.

14. The image forming apparatus according to claim 11, wherein the first toner cartridge is arranged above the first image forming unit and the second toner cartridge is arranged above the second image forming unit in the vertical direction.

15. The image forming apparatus according to claim 11, wherein a position of the first toner cartridge is arranged closer to an exhaust port of the duct than a position of the second toner cartridge is to the exhaust port of the duct.

16. The image forming apparatus according to claim 11, wherein the duct is configured to extend along a discharging direction in which the recording material is discharged from the image forming apparatus, and the duct is configured such that a discharging port of the duct is arranged downstream of the first toner cartridge.

17. The image forming apparatus according to claim 16, wherein the first toner cartridge is provided downstream of the second toner cartridge in the discharging direction.

18. An image forming apparatus comprising:

first and second image forming units each comprising an image bearing member and a developing unit forming a toner image on the image bearing member, and configured to form the toner image on a recording material;

an image heating unit configured to heat the image formed on the recording material;

a supporting unit, provided above the first and second image forming units in a vertical direction, configured to support the recording material discharged from the image forming apparatus;

a duct, provided below the supporting unit in the vertical direction, configured to discharge heat in a vicinity of the image heating unit to an outer side of the image forming apparatus;

a frame body of the image forming apparatus;

a first toner cartridge which is provided below the duct in the vertical direction, the first toner cartridge being configured to be inserted into the image forming apparatus in a direction directed from a front side of the image forming apparatus toward a rear side of the image forming apparatus, and configured to store toner to be supplied to the developing unit of the first image forming unit;

a second toner cartridge which is provided below the duct in the vertical direction and adjacent to the first toner cartridge, the second toner cartridge being configured to be inserted into the image forming apparatus in the direction directed from the front side of the image forming apparatus toward the rear side of the image forming apparatus, and configured to store toner to be supplied to the developing unit of the second image forming unit; and a stay respectively connected to a front side portion of the frame body and a rear side portion of the frame body, the first toner cartridge and the duct being oppositely arranged with the stay interposed therebetween in the vertical direction, the second toner cartridge and the duct being oppositely arranged without the stay interposed therebetween in the vertical direction.

19. The image forming apparatus according to claim 18, wherein a clearance is formed between the duct and the stay and a clearance is formed between the stay and the first toner cartridge in the vertical direction.

20. The image forming apparatus according to claim 18, wherein the stay is a metal plate.

21. The image forming apparatus according to claim 18, wherein the first toner cartridge is arranged above the first image forming unit and the second toner cartridge is arranged above the second image forming unit in the vertical direction.

22. The image forming apparatus according to claim 18, wherein a position of the first toner cartridge is arranged closer to an exhaust port of the duct than a position of the second toner cartridge is to the exhaust port of the duct.

23. The image forming apparatus according to claim 18, wherein the duct is configured to extend along a discharging direction in which the recording material is discharged from the image forming apparatus, and the duct is configured such that a discharging port of the duct is arranged downstream of the first toner cartridge.

* * * * *